United States Patent [19]

Goodwin et al.

[11] 4,196,762

[45] Apr. 8, 1980

[54] SKI BAG

[76] Inventors: Jerry L. Goodwin, 4582 Gatetree Cir., Pleasanton, Calif. 94566; Warren C. McCann, 300 Appian Way, Union City, Calif. 94587

[21] Appl. No.: 934,189

[22] Filed: Aug. 16, 1978

[51] Int. Cl.[2] ..... A45C 11/00

[52] U.S. Cl. ..... 150/52 R; 224/45 S

[58] Field of Search ..... 150/3, 52 R; 206/315 R; 224/45 S; 280/11.37 K

[56] References Cited

U.S. PATENT DOCUMENTS

| | | | |
|---|---|---|---|
| 1,479,134 | 1/1924 | Guinzburg | 150/52 R X |
| 1,525,344 | 2/1925 | Viegelmann | 150/52 R |
| 3,245,448 | 4/1966 | Rea | 150/52 R |
| 3,336,961 | 8/1967 | Welsh | 150/52 R |
| 3,826,296 | 7/1974 | Morris | 150/3 |
| 3,865,166 | 2/1975 | Pedro | 150/52 R |
| 3,948,302 | 4/1976 | Kohls | 150/52 R |

FOREIGN PATENT DOCUMENTS

| | | | |
|---|---|---|---|
| 1185924 | 2/1959 | France | 150/52 R |

*Primary Examiner*—Donald F. Norton

*Attorney, Agent, or Firm*—Roland I. Griffin

[57] ABSTRACT

A pair of matching side panels of indoor-outdoor carpet material and a strip of nylon edge reinforcing tape are stitched together along two sides and one end of the side panels to form an elongated bag for transporting skis, ski poles, and the like. Oppositely facing strips of hook- and loop-type fastening tape are stitched in place along adjoining inner portions of these side panels at the other end thereof to permit opening and closing of the bag. A nylon webbing handle is stitched to both side panels along one side thereof to facilitate transporting the bag, and a metal ring is secured to one of the side panels at the same end as the corresponding strip of fastening tape to permit hanging the bag for drying or storage.

3 Claims, 4 Drawing Figures

SKI BAG

BACKGROUND OF THE INVENTION

This invention relates to ski bags for transporting and storing skis, ski poles, and the like and, more particularly, to a flexible ski bag without slide fasteners, latches, or other moving parts and to a method of making such a ski bag.

Since skis and ski poles are expensive, it is desirable to adequately protect them during transportation and storage. This is difficult due to their relatively large size, awkward shape, bindings, and cutting edges. Skis and ski poles are therefore commonly carried on a car top rack where they are undesirably exposed to the weather. In U.S. Pat. No. 3,737,171 there is disclosed a protective enclosure made of a water-impermeable material for enclosing the binding portions of skis. This enclosure may be employed while the skis are mounted on a car top rack, but still leaves the remaining portions of the skis unprotected and, like the car top rack, does not facilitate transporting the skis and ski poles to and from the car, the ski slopes, or a place of storage and does not facilitate storing the skis and ski poles.

In U.S. Pat. Nos. 3,245,448 and 3,336,961 there are disclosed flexible ski bags for facilitating the transporting and storing of skis, ski poles, and the like. Each of these ski bags employs a slide fastener that extends over the major portion of the length of the ski bag, waterproof material that extends over a substantial portion or all of the ski bag, and one or more rather bulky carrying straps or handles that extend along the central portion of the ski bag. One disadvantage of this type of ski bag, and also of the above-mentioned protective enclosure of U.S. Pat. No. 3,737,171, is that the waterproof material employed therein inhibits moisture that may be trapped inside the ski bag from escaping, thereby increasing the possibility of corrosion of ski equipment contained in the ski bag and of mildew and rot of the ski bag itself. Another disadvantage of this type of ski bag is that slide fasteners and other such fasteners with moving parts can become defective during use and are also subject to corrosion due to moisture both inside and outside of the ski bag. Still another disadvantage of this type of ski bag is that it cannot be easily folded or rolled up into a small package when not in use due to the generally bulky construction of the carrying straps or handles and other portions of the ski bag.

SUMMARY OF THE INVENTION

It is an object of this invention to provide an improved flexible ski bag that overcomes the foregoing disadvantages of prior art ski bags.

Another object of this invention is to provide a less expensive ski bag that has adequate padding to protect skis and ski poles contained therein from damage and to protect the person transporting them, and other persons, from injury, that permits moisture to escape throughout virtually the entire surface area of the ski bag, that employs a durable material which is not adversely affected by inclement weather and which quickly dries throughout even when the ski bag is left closed, that has no slide fasteners or other such moving parts, that permits easy and rapid insertion and removal of skis and ski poles, that can be folded or rolled into a small package for easy storage when not in use, and that includes provision for hanging the bag for drying or storage.

Still another object of this invention is to provide a method for efficiently making a flexible ski bag without slide fasteners or other such moving parts.

Other and incidental objects of this invention will become apparent from a reading of this specification and an inspection of the accompanying drawings.

The foregoing objects are accomplished according to the illustrated preferred embodiment of this invention by forming a pair of matching elongated side panels from a non-waterproof indoor-outdoor carpet material by stitching a strip of nylon edge reinforcing tape overlapping one end of one side panel and a strip of hook-type fastening tape overlapping a portion of that strip of edge reinforcing tape to that side panel in one sewing operation; by stitching a strip of nylon edge reinforcing tape overlapping the corresponding end of the other side panel, a strip of loop-type fastening tape overlapping a portion of that strip of edge reinforcing tape, and a nylon metal-ring-retaining loop partially disposed between that strip cf edge reinforcing tape and that strip of loop-type fastening tape to that other side panel in one sewing operation; by placing the side panels in side-by-side relationship with the strips of hook-type and loop-type fastening tape facing each other; by stitching the adjoining side panels and a strip of nylon edge reinforcing tape overlapping both sides and the other end of those side panels together along the sides and that other end in one sewing operation; and by stitching a handle formed from a strip of nylon webbing to the side panels during the last-mentioned sewing operation with each end portion of the handle overlapping a different side panel.

This forms a flexible and well-padded ski bag that greatly facilitates transporting and storing of skis, ski poles, and the like while at the same time protecting the ski equipment contained therein from damage and the person transporting the ski equipment, and other persons, from injury due to the awkward shape, sharp edges, pointed ends, etc. of the ski equipment. The ski bag may be quickly opened at one end for insertion or removal of skis or ski poles without the need for operating slide fasteners or other defect prone moving parts by simply pulling the strips of hook- and loop-type fastening tape apart and may be quickly and securely closed to protect the ski equipment contained therein by simply pressing the same strips of hook- and loop-type fastening tape back together. Moreover, the ski bag wears well, is not adversely affected by weather, can be easily folded or rolled into a relatively small package when not in use, and is air and water permeable so as not to trap moisture therein that might otherwise cause corrosion or mildew and so as to be easily dried out without even being opened.

DETAILED DESCRIPTION OF THE PREFERRED EMBODIMENT

Figure 1:
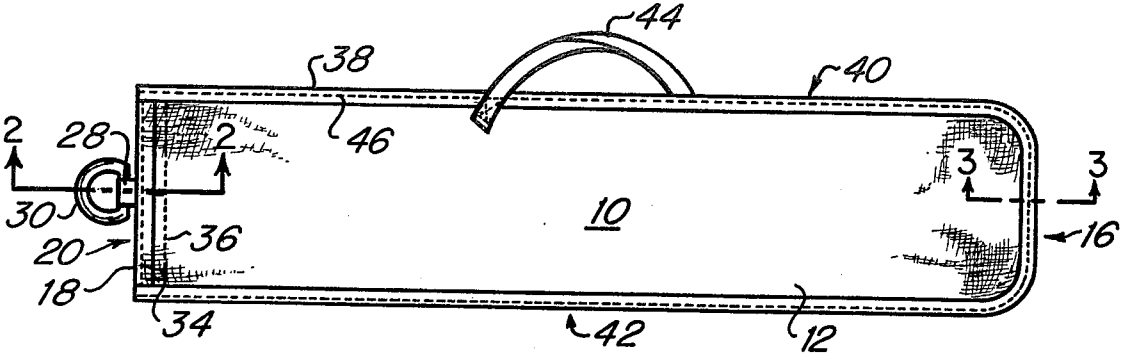
FIG. 1 is a plan view of a ski bag according to the preferred embodiment of this invention.
Figure 2:
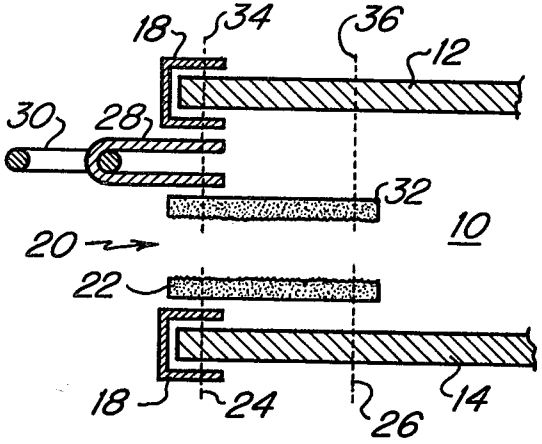
FIG. 2 is an exaggerated sectional view of the ski bag taken along the line 2—2 of FIG. 1.

Referring to FIGS. 1 and 2, there is shown a ski bag 10 constructed according to the preferred embodiment of this invention by cutting a pair of matching, generally-rectangular; elongated side panels 12 and 14 from an indoor-outdoor carpet material about one-eighth to one-quarter of an inch in thickness (such as ARMSTRONG nylon indoor-outdoor carpet). The side panels 12 and 14 are made of sufficient width and length (about twelve inches by seventy-seven inches each) to accommodate the skis and ski poles to be transported and/or stored in the ski bag 10 and are generally rectangular in shape with rounded corners at one end 16 (hereinafter referred to as the bottom end). A separate strip 18 of nylon edge reinforcing tape is disposed to overlap the edge of each side panel 12 and 14 along the opposite end 20 (hereinafter referred to as the top end). This and all other edge reinforcing tape employed in fabricating the ski bag 10 is about one inch in width and about fifteen to twenty-two thousandths of an inch in thickness.

A strip 22 of hook-type fastening tape (such as VELCRO nylon hook tape No. 100-08-200-0199AA) about one inch in width is disposed along the top end 20 of one side panel 14 over a portion of the corresponding strip 18 of edge reinforcing tape. The strip 22 of hook-type fastening tape is stitched with the corresponding strip 18 of edge reinforcing tape to the side panel 14 along one side of the strip 22 (as indicated at 24) and is further stitched to the side panel 14 along the other side of the strip 22 (as indicated at 26) in one sewing operation. In this and the other sewing operations performed in fabricating the ski bag 10 a thread such as number 16 dacron thread and eight stitches to the inch are employed).

Both ends of a nylon loop 28 for retaining a D-shaped chrome-plated metal ring 30 are centrally disposed along the top end 20 of the other side panel 12 over a portion of the corresponding strip 18 of edge reinforcing tape. The loop 28 is made of the same tape as the strips 18 of edge reinforcing tape. A strip 32 of loop-type fastening tape (such as VELCRO nylon loop tape No. 100-001-200-0199DW) about one inch in width is disposed along the top end 20 of the side panel 12 over both ends of the loop 28. The strip 32 of loop-type fastening tape is stitched with the corresponding strip 18 of edge reinforcing tape and the loop 28 to the side panel 12 along one side of the strip 32 (as indicated at 34) and is further stitched to the side panel 12 along the other side of the strip 32 (as indicated at 36) in another sewing operation. The side panels 12 and 14 are then placed in side-by-side relationship with the strips 22 and 32 of hook- and loop-type fastening tape facing each other as best shown in FIG. 2.

Figure 4:
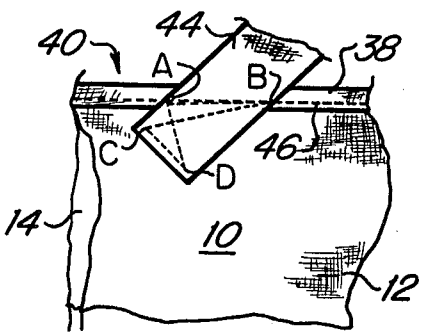
FIG. 4 is a view of a portion of the ski bag of FIGS. 1-3 showing how the handle is secured to the side panels thereof.
Figure 3:
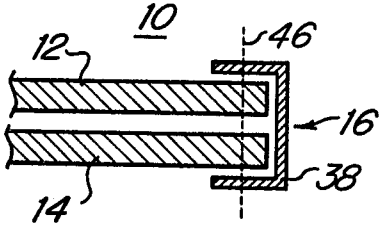
FIG. 3 is an exaggerated sectional view of the ski bag taken along the line 3—3 of FIG. 1.

Referring now to FIGS. 1 and 3, a continuous strip 38 of edge reinforcing tape is disposed to overlap the adjoining edges of the side panels 12 and 14 along both sides 40 and 42 and the bottom end 16 thereof. A nylon handle 44 is centrally disposed along side 40 of the side panels 12 and 14 with one end portion overlapping a portion of the strip 38 of edge reinforcing tape and a portion of one side panel and with the other end portion overlapping another portion of the strip 38 of edge reinforcing tape and a portion of the other side panel. Handle 44 is made of type number 7 nylon webbing about one inch in width. The side panels 12 and 14, the strip 38 of edge reinforcing tape, and the handle 44 are stitched together along both sides 40 and 42 and the bottom end 16 of the side panels (as indicated at 46) in a last sewing operation. As best shown in FIG. 4, each end portion of the handle 44 is stitched to the side panels 12 and 14 along a zigzag path as generally indicated from point A to point B, then to point C, then to point D, then back to point A, and then back to point B and on along side 40 of the side panels 12 and 14.

The completed ski bag 10 may be quickly opened at the top end 20 thereof to permit insertion or removal of skis, ski poles, or the like by simply pulling the strips 22 and 32 of hook- and loop-type fastening tape apart to disengage them and may be quickly and securely closed to protect the ski equipment contained therein by simply pressing the strips 22 and 32 of hook- and loop-type fastening tape together to engage them. Handle 44 facilitates transporting of the ski bag 10 and the ski equipment contained therein and yet is formed and positioned so as not to interfere with folding or rolling of the ski bag into a relatively small package when the ski bag is not in use. The ring 30 facilitates hanging of the ski bag 10 for drying and/or storage. Since the ski bag 10 is formed entirely with side panels of water-permeable, weather-resistant, indoor-outdoor carpet, strips of nylon edge reinforcing and fastening tape, a handle of nylon webbing, a loop of nylon tape, a chrome-plated ring, and dacron stitching, the ski bag is not adversely affected by inclement weather, does not trap moisture that might otherwise cause corrosion of ski equipment contained therein and mildew or rot of the ski bag itself, and is easily dried out without opening the ski bag. The ski bag is flexible and yet well padded for protecting the ski equipment contained therein and for protecting the person transporting the ski bag, and other persons, from being injured by the ski equipment contained therein. Moreover, the ski bag 10 may be fabricated efficiently with a minimum of parts and operations as described above and therefore at substantially lower cost than prior art ski bags.

We claim:

1. A flexible ski bag for completely enclosing a pair of skis or the like from end to end, said bag comprising first and second matching, elongated, generally-rectangular side panels of an air-permeable, weather-resistant, indoor-outdoor carpet material secured together in side-by-side relationship along both sides and one end thereof; a strip of nylon edge reinforcing tape overlapping the adjoining edges of both side panels along both sides and said one end thereof, the side panels and the strip of edge reinforcing tape being stitched together along both sides and said one end thereof to secure the side panels together; a separate strip of nylon edge reinforcing tape overlapping the edge of each side panel along the other end thereof; first and second strips of fastening tape secured to the first and second side panels, respectively, along said other end thereof in oppositely-facing relationship for engaging one another when pressed together to close the bag and for being disengaged from one another when pulled apart to open the bag, the first strip of fastening tape comprising a strip of hook-type fastening tape stitched with a corresponding one of the last-mentioned strips of edge reinforcing tape to the first side panel along said other end thereof and the second strip of fastening tape comprising a strip of loop-type fastening tape stitched with a corresponding one of the last-mentioned strips of edge reinforcing tape to the second side panel along said other end thereof; a ring for use in hanging the bag; a loop of nylon tape passing through the ring and stitched to one of the side panels along a central portion of said other end thereof to form a ring-retaining loop for holding the ring; and a strip of nylon webbing having one end portion stitched to the side panels along a central portion of one side of one of the side panels and having another end portion stitched to the side panels along a central portion of the same side of the other of the side panels to form a handle for facilitating the transporting of the bag.

2. A flexible ski bag as in claim 1 wherein the side panels have rounded corners at said one end.

3. A flexible ski bag as in claim 2 wherein the ring comprises a chrome-plated metal ring.

* * * * *